United States Patent [19]

Pemberton

[11] 4,283,104

[45] Aug. 11, 1981

[54] ELECTRICAL TERMINAL ASSEMBLY

[75] Inventor: Donald S. Pemberton, Stoke-on-Trent, England

[73] Assignee: Lucas Industries Limited, Birmingham, England

[21] Appl. No.: 42,537

[22] Filed: May 25, 1979

[30] Foreign Application Priority Data

May 26, 1978 [GB] United Kingdom ..... 23447/78

[51] Int. Cl.[3] ..... H01R 13/40; H01R 13/58

[52] U.S. Cl. ..... 339/97 R; 339/107

[58] Field of Search ..... 339/97, 98, 99, 107

[56] References Cited

U.S. PATENT DOCUMENTS

| | | | |
|---|---|---|---|
| 3,576,518 | 4/1971 | Bazille, Jr. | 339/98 |
| 3,804,971 | 4/1974 | Bazille, Jr. | 339/98 X |
| 3,879,099 | 4/1975 | Shaffer | 339/107 X |
| 3,910,671 | 10/1975 | Townsend | 339/97 R |
| 3,955,873 | 5/1976 | Peterson | 339/99 R |
| 4,099,819 | 7/1978 | Keglewitsch | 339/99 R X |
| 4,159,158 | 6/1979 | Weidler | 339/97 P |

*Primary Examiner*—John McQuade
*Assistant Examiner*—John S. Brown
*Attorney, Agent, or Firm*—Scrivener, Clarke, Scrivener and Johnson

[57] ABSTRACT

An electrical terminal assembly for releasably connecting a branch lead to a through lead without disturbing the continuity of the through lead has an insulating housing in two, snap-engaging parts fitted on opposite sides of the through lead. The body part holds a metal terminal member made from a flat blank and formed at one end as a socket of a flat blade plug and socket connector. A flat blade connector on the branch lead can be inserted in the socket through an aperture in the body part. The other end of the terminal member is bent into tubular shape leaving a gap between its edges. An aligned slot is formed in the opposite wall. The edges of the gap and slot pierce the insulation of the conductor and make contact with its core when the two body parts are interengaged about the conductor.

10 Claims, 5 Drawing Figures

ELECTRICAL TERMINAL ASSEMBLY

This invention relates to an electrical terminal assembly for attachment to a conductive lead.

It is desirable to be able to make an electrical connection to a conductive lead intermediate its ends and without disturbing the continuity of the lead. Devices are known whereby a connection can be made between a first lead intermediate its ends and a second lead but these devices suffer from the disadvantage that the connection between the leads is a permanent connection, or, if not actually permanent, is certainly not suitable for repeated connection and disconnection. Known devices include means for piercing the insulating sheath, if necessary, of both the first and second leads in order to make contact with their respective conductive cores.

It is an object of the present invention to provide a terminal assembly for attachment to an electrical lead, if necessary along the length of the lead, so that the terminal assembly and a mating terminal afford the possibility of making a detachable electrical connection to the lead.

It is a further object of the present invention to provide a terminal assembly comprising an insulating housing through which the lead to which a connection is to be made extends in use, a terminal member carried by the housing and including a first portion for engagement in use by a complementary mating terminal, and a second portion which in use engages and makes electrical contact with the lead within the housing, the housing being arranged to be fitted around the lead in use, and the second portion of the terminal member being arranged to pierce the insulating sheath of the lead if necessary and to contact the conductive core of the lead.

It is another object of the present invention to provide in such a terminal assembly having a housing which is a two part housing assembled around the lead and in which the terminal member and the housing parts are so arranged that assembly of the housing parts around the lead causes engagement of the second terminal member portion with the lead, the second terminal member portion automatically piercing the insulating sheath of the lead, if necessary. Preferably the housing parts are interengageable as a snap-fit.

It is yet another object of the invention to provide in such a terminal assembly in which the second portion of the terminal member includes a blade having a slot therein, the lead in use being received in the slot and the edges thereof piercing the insulating sheath of the lead if necessary to contact the core of the lead. The second portion of the terminal member may be of generally tubular shape having aligned slots or gaps in opposite walls thereof for similar contact with the conductive core at spaced positions along the lead. The tubular shape may be formed as a closed tube or by bending a sheet metal blank into tubular shape but leaving a gap between confronting edges to serve a similar core-engaging function.

It is still another object of the invention to provide in such a terminal assembly that one of the housing parts has a projection over which the lead extends, the projection forcing the lead into the or each slot or gap as the housing parts are interengaged.

Conveniently the terminal member is received wholly within the housing and the housing is apertured to permit, in use, insertion of a terminal which mates with the terminal portion of the terminal member.

The invention will now be described, by way of example only, with reference to the accompanying drawings in which.

Figure 1:
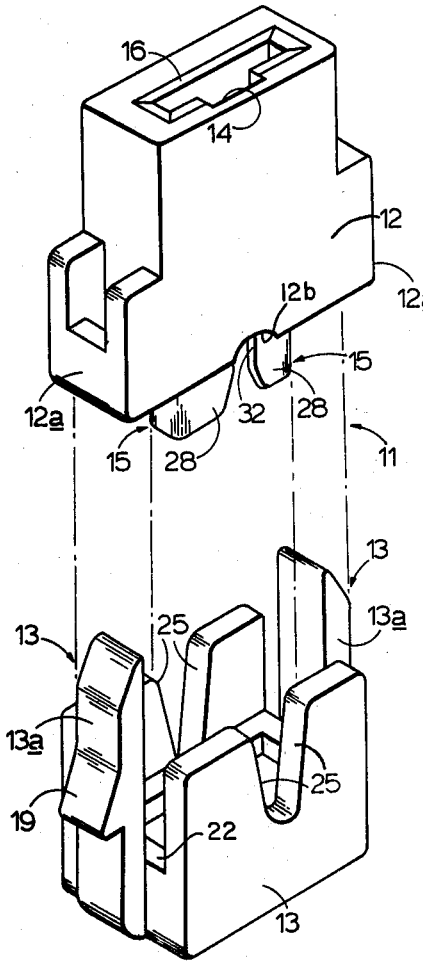
FIG. 1 is a perspective view of a terminal assembly.
Figure 2:
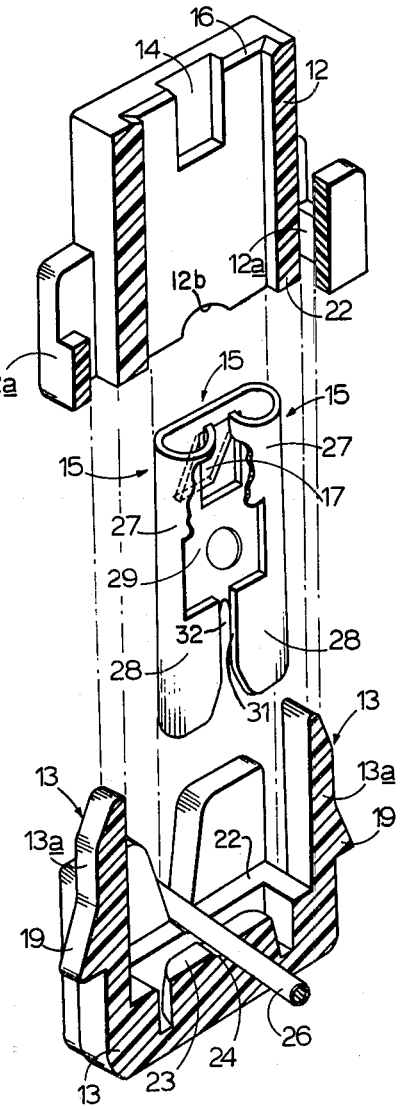
FIG. 2 is an exploded, perspective view, partly in section, of the assembly shown in FIG. 1.
Figure 3:
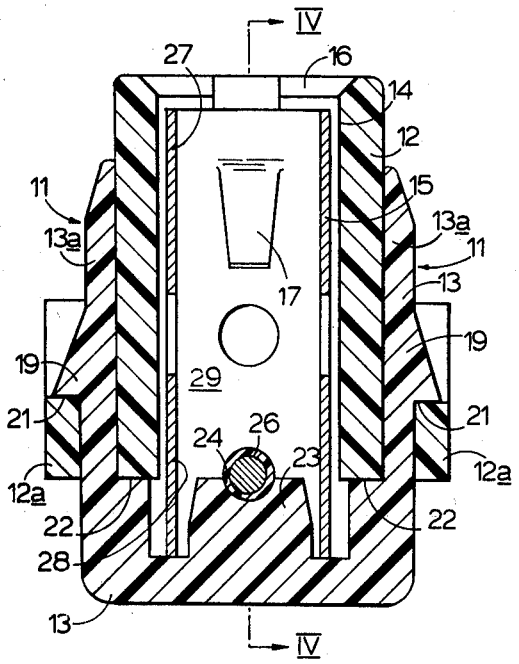
FIG. 3 is a sectional view on the line III—III in FIG. 4.
Figure 5:
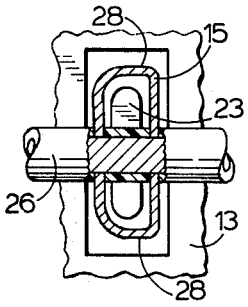
FIG. 5 is a sectional view on the line V—V in FIG. 4.

Referring to the drawings the terminal assembly comprises a moulded synthetic resin housing 11 formed in two parts 12, 13. The part 12 is hollow, the passage 14 thereof receiving a metal terminal member 15. At one end of the body part 12 is an aperture 16 whereby, in use, access is gained to the terminal member 15 within the housing. The terminal member 15 is inserted into the passage 14 of the body part 12 from its end remote from the aperture 16, the terminal member 15 including a resilient tongue 17 which during insertion of the terminal member 15 into the passage 14 is flexed away from its normal rest position, and which, when the terminal member 15 reaches a predetermined position within the passage 14, springs out to engage behind a shoulder 18 in the wall of the passage 14 to retain the terminal member 15 within the passage 14.

The end of the body part 12 remote from the aperture 16 is engageable within the body part 13.

The body parts 12, 13 are generally of rectangular cross-section, and a pair of opposite walls on the body part 13 are formed with legs 13*a* formed integrally with respective ramps 19. Each of the ramps 19 terminates at its highest end, in a shoulder 21 extending laterally of the respective leg 13*a*. The body part 12 is formed with a pair of oppositely directed integral U-shaped bridges 12*a* which define with the remainder of the body part 12 a pair of passages through which the legs 13*a* pass during interengagement of the body parts. Interengagement of the body parts 12, 13 is limited by abutment of the end of the body part 12 with an internal shoulder 22 of the body part 13. The ramps 19 and bridges 12*a* are so arranged that when the end of the body part 12 engages the shoulder 22 the ramps 19 have passed completely beneath the bridges 12*a*, the bridges 12*a* flexing to permit passage of the ramps and then snapping back to their original configuration to engage behind the shoulders 21. It may be arranged that the ramps 19 also flex to a limited extent. Thus it will be recognised that the body parts 12, 13 are interengaged as a snapfit, and in the interengaged position further interengaging movement is prevent by abutment with the shoulder 22 and withdrawal of the body part 12 from the body part 13 is resisted by abutment between the bridges 12*a* and the shoulders 21.

The inner wall of the base of the body part 13 is formed with an integral projection 23 extending in the same direction as the legs 13*a* and having a part circular groove 24 at its free end. Aligned with the groove 24 in the appropriate opposite walls of the body part 13 are respective slots 25. The closed ends of the slots 25 are also part circular and are co-axial with the groove 24.

The end of the body part 12 remote from the aperture 16 is also formed with a part circular groove 12*b* the axis of which extends parallel to, but slightly spaced from the axis of the groove 24 when the body parts 12, 13 are fully interengaged.

Figure 4:
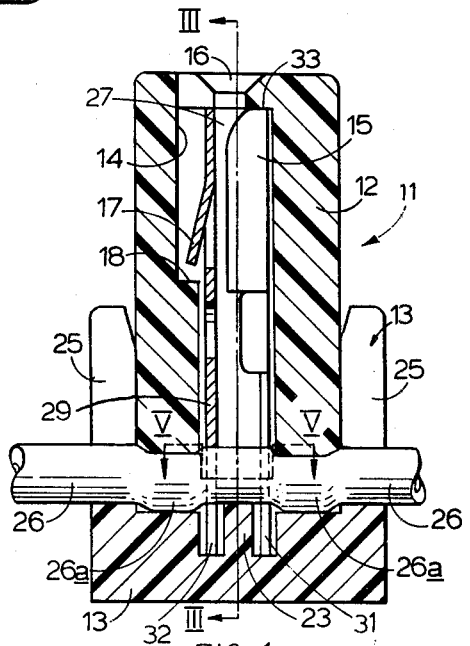
FIG. 4 is a sectional view on the line IV—IV in FIG. 3.

When the terminal assembly is to be applied to a conductive lead 26 the lead 26 is engaged in the body part 13 by, in effect being laid across the body part within the slots 25, and the groove 24 of the projection 23. Thereafter, when the body part 12 is interengaged with the body part 13, the portions of the lead within the body part 13 on opposite sides of the projection 23 are received by the part-circular groove in the end of the body part 12, but since the axis of the groove in the body part 12 is parallel to but slightly spaced from the axis of the groove 24 in the projection 23, the lead is deformed on each side of the projection 23, between the projection 23 and the groove 25. The two deformed regions 26*a* can best be seen in FIG. 4. The deforming action performed on the lead by interengagement of the two body parts serves to clamp the terminal assembly onto the lead in a manner to resist longitudinal movement of the lead relative to the terminal assembly.

The terminal member 15 comprises first and second integrally formed portions 27, 28. The terminal member 15 is formed from a single flat brass blank which is subsequently shaped so that the first portion 27 of the terminal member 15 constitutes a receptacle, that is to say, a socket terminal for receiving a mating flat blade terminal, while the second portion 28 is a lead-engaging portion. The form of the portion 27 is relatively well known, and is very similar to the socket part of a conventional flat plug and socket connector unit. It is the portion 27 of the terminal member 15 which includes the resilient tongue 17 for retaining the terminal member 15 within the passage 14 of the body part 12. The tongue 17 is struck from a plane base wall 29 which is common to both the portions 27 and 28. In the portion 27 side walls extending at right angles to the base wall 29 are rolled over to define a pair of resilient members extending towards the base wall 29 and which in use serve to grip a blade terminal inserted between the ends of the rolled over portion and the base wall 29. At the opposite end of the terminal member 15, that is to say in the portion 28 thereof, the upstanding side walls are merely turned in towards one another, although not sufficiently far to touch one another, thus leaving a gap 31 extending lengthwise of the terminal member 15. The base wall 29 of the portion 28 is formed with a longitudinally extending slot 32 of width equal to the width of the gap 31, and aligned therewith. The inturned side walls are so shaped that the gap 31, at the end of the terminal member 15 is flared outwardly to define a "lead-in" to the gap 31. The slot 32 is similarly shaped at its open end.

As mentioned above withdrawal of the terminal member 15 from the body part 12 is prevented by the tongue 17. The junction of the passage 14 and the apertures 16 of the body part 12 is shaped to define a shoulder 33 (FIG. 4) against which the end of the portion 27 of the terminal member 15 can abut. The overall length of the terminal member 15 is such that the end region of the portion 28 thereof projects from the end of the passage 14 of the body part 12.

Assuming that the lead 26 has been engaged in the body part 13, then during insertion of the body part 12 into the body part 13, the lead is engaged by the "lead-in" of the slot 32 and the gap 31, on opposite sides respectively of the projection 23. The width of the gap 31 and slot 32 is slightly smaller than the diameter of the conductive core of the lead 26. As the body parts 12, 13 are moved further towards their fully interengaged position, the lead 26 is driven into the gap 31 and the slot 32 and the edges of the gap 31 and slot 32 thus cut through the external insulating sheath of the cable 26 and tightly engage the conductive core of the lead thus making an electrical connection thereto without disturbing the longitudinal integrity of the lead.

It will be recognised therefore that in the fully interengaged position of the body parts 12, 13 the terminal member 15 is electrically connected to the lead 26 within the terminal assembly, and thus a mating blade terminal introduced into the terminal member 15 by way of the aperture 16 of the body part 12 will be electrically connected by way of the terminal member 15 to the core of the lead 26.

It is to be understood that the terminal member 15 can embody a large variety of different forms of terminal other than the flat socket terminal described above. For example, the terminal could be a cylindrical socket type terminal, a cylindrical pin type terminal or a flat blade terminal. Although a single wire conductive core is shown in the drawings, the terminal assembly may equally be used with a multi-wire core.

The two housing parts may be held captive one to the other by being integrally united by a flexible strap portion, formed, for example, in a unitary moulding comprising the strap portion and both housing parts.

I claim:

1. A terminal assembly for releasably connecting a branch lead to a through lead without disturbing the continuity of the through lead, the terminal assembly comprising an insulating housing assembly, having first and second housing parts releasably interlockable to close the housing assembly, and a conductive terminal member contained within the closed housing assembly, the terminal member being elongated and of unitary sheet metal construction and having at opposite ends first and second terminal portions, the first terminal portion defining contact means for releasable engagement in use by a complementary mating terminal of the branch lead and the first terminal portion and the first housing part having means interengageable to retain the terminal member captive within the first housing part with at least part of the second terminal portion protruding therefrom, the second terminal portion being of open-ended generally tubular shape and having side walls extending from opposite edges of a base wall and turned in towards one another but so as to leave a gap between confronting edges thereof and an open-ended slot aligned with said gap being formed in said base wall, said gap and said slot being of similar width and at the end of said second portion of the terminal member being outwardly flared, the second housing part being shaped as a cap adapted to cover said protruding part of the second terminal portion in the closed housing assembly and having a projection shaped to enter the open end of the second terminal portion, and through-lead locating means for receiving a through lead laid across the second housing part when the latter is disengaged from the first housing part and locating said through lead over said projection and in line with said gap and said slot of said second terminal portion, said second housing part having spaced walls embracing said first housing part in the closed housing assembly, said through-lead locating means comprising, at least in part, open ended notches in said spaced walls, which, in the closed housing assembly align with said gap and said slot in said second terminal portion, the entry of said projection into said open end of said second terminal portion forcing said through lead into said gap and said slot as said housing parts are interengaged, and said second terminal portion being arranged to automatically pierce the insulating sheath of said through lead if necessary and to contact the conductive core of said through lead.

2. A terminal assembly according to claim 1 wherein said housing parts are interengageable as a snap-fit.

3. A terminal assembly according to claim 1 wherein one of said housing parts being formed with spaced legs each including a ramp terminating in a shoulder extending laterally of said leg and said other housing part being formed with means for receiving said legs and co-operating in snap action with said ramps and shoulders during interengagement of said housing parts and to retain said housing parts when fully engaged one with the other.

4. A terminal assembly according to claim 1 wherein said terminal member is received wholly within said closed housing assembly and said housing assembly is apertured to permit, in use, insertion of a terminal which mates with the first portion of the terminal member.

5. A terminal assembly according to claim 1 wherein said first portion of said terminal member is in the form of a socket for receiving a mating flat blade terminal constituting a flat plug and socket connector.

6. A terminal assembly according to claim 1 wherein the first terminal portion has side walls extending from a base wall portion in the first portion and rolled over to define a pair of resilient members extending towards said base wall portion, free ends of said resilient members being spaced from said base wall portion to form a socket adapted to receive a blade terminal of the branch lead, said resilient members in use serving to grip such a blade terminal inserted between said ends of said resilient members and said base wall portion.

7. A terminal assembly according to claim 1 wherein confronting faces of said first and second housing parts have intermediate formations which co-operate in the closed housing assembly to grip said through lead on opposite sides of said terminal member and between said spaced walls and said terminal member.

8. A terminal assembly according to claim 7 wherein in the closed housing assembly said intermediate formations support a through lead at a position laterally displaced from that at which such through lead is supported by said open-ended notches and said projection, the deformation of the through lead so caused resisting longitudinal movement of the through lead relative to the terminal assembly.

9. A terminal assembly for releasably connecting a branch lead to a through lead without disturbing the continuity of the through lead, the terminal assembly comprising an insulated housing assembly, having first and second housing parts releasably interlockable to close the housing assembly, and a conductive terminal member contained within the closed housing assembly, said terminal member and said first housing part having means interengageable to retain said terminal member captive within said first housing part, said terminal member being elongated and of unitary sheet metal construction and of generally partially flattened tubular form and having at opposite ends first and second terminal portions and having a base wall and side walls extending curvedly from opposite sides of said common base wall throughout its length, said common base wall being substantially flat and extending longitudinally through, and being common to, said first and second terminal portions, first marginal portions of said side walls in said first terminal portion being divided from second marginal portion of said side walls in said second terminal portion, said first marginal portions being rolled over to define a pair of resilient members extending towards the portion of said base wall in said first terminal portion, free ends of said resilient members being spaced from said base wall portion to form a socket adapted to receive a blade terminal of the branch lead; said resilient members in use serving to grip such a blade terminal inserted between said ends of said resilient members and said base wall portion, said second terminal portion having at least a part thereof protruding from the first housing part and being of open-ended generally tubular shape and having said side walls extending from opposite edges of said common base wall turned in towards one another but so as to leave a gap between confronting edges thereof and an open ended slot aligned with said gap being formed in said base wall, said gap and said slot being of similar width and at the end of said second portion of the terminal member being outwardly flared, said second housing part being shaped as a cap adapted to cover said protruding part of the second terminal portion in the closed housing assembly and having a projection shaped to enter the open end of the second terminal portion and through lead locating means for receiving a through lead laid across the second housing part when disengaged from the first housing part and locating said through lead over said projection and in line with said gap and said slot of said second terminal portion, the entry of said projection into said open end of said second terminal portion forcing said through lead into said gap and said slot as said housing parts are interengaged, and said second terminal portion being arranged to automatically pierce the insulating sheath of said through lead if necessary and to contact the conductive core of said through lead.

10. A terminal assembly according to claim 9 wherein said first housing part defines a through passage and has an internal shoulder at the end of said through passage remote from said second housing part in the closed housing assembly, the end of said first terminal portion of said terminal member abutting said shoulder, said shoulder constituting means resisting load on the terminal member due to engagement of said second terminal portion with a through lead and defining an aperture to permit, in use, insertion of said blade terminal.

* * * * *